US007337738B2

(12) United States Patent
Hu

(10) Patent No.: US 7,337,738 B2
(45) Date of Patent: Mar. 4, 2008

(54) GATE TYPE VERTICAL ELEVATED MAST

(75) Inventor: Dexiang Hu, Liaoning (CN)

(73) Assignee: Equipment Engineering Company of Liaohe Petroleum Exploration Bureau, CNPC, Liaoning (CN)

( * ) Notice: Subject to any disclaimer, the term of this patent is extended or adjusted under 35 U.S.C. 154(b) by 0 days.

(21) Appl. No.: 11/404,909

(22) Filed: Apr. 17, 2006

(65) Prior Publication Data

US 2007/0240622 A1 Oct. 18, 2007

(51) Int. Cl.
*B63B 15/00* (2006.01)

(52) U.S. Cl. ..... 114/90

(58) Field of Classification Search ..... 114/89, 114/90

See application file for complete search history.

(56) References Cited

U.S. PATENT DOCUMENTS 792,924 A * 6/1905 Fosgate ..... 114/90
4,838,191 A * 6/1989 Corlett et al. ..... 114/90
5,515,945 A * 5/1996 Smith et al. ..... 187/226

* cited by examiner

*Primary Examiner*—Stephen Avila
(74) *Attorney, Agent, or Firm*—Birch, Stewart, Kolasch & Birch, LLP

(57) ABSTRACT

A vertically elevated gate mast with open front that is divided into multiple sections and is assembled section by section from bottom to the top. The first section is an integrated structure, and $2^{nd}$ to nth sections are divided into a left part and a right part. Each left and right part is assembled by connecting front upright posts, back upright posts, upper beams, lower beams and brace rods. Corresponding left and right parts are then connected with back beams and brace rods to form each section with beams and brace rods at the left, right and back sides. Lifting and lowering of the mast is realized by drawworks. Installation is performed from the ground, by assembling the left parts and the right parts with the back beams and the brace rods into a shape of gate, and then lifting each section as a whole with a crane.

5 Claims, 6 Drawing Sheets

GATE TYPE VERTICAL ELEVATED MAST

BACKGROUND OF THE INVENTION

Generally there are two types of mast nowadays: tower-type mast and horizontal mast. Both types are assembled parts by parts. Since they are assembled and dismantled parts by parts, so they have long preparation period before installation and mobilization. It is dangerous when assembling tower-type mast because it has to be operated in the air. The assembling of horizontal mast requires enough space, therefore, occupies a large area.

DESCRIPTION OF THE INVENTION

This new type of gate vertical elevated mast will solve the above technical problems. The mast is divided into several sections, each section has two parts, one is on the left and the other is on the right. It can be elevated vertically in a small area. It takes less time to prepare before mobilization and, it is assembled on a ground base so it avoids overhead operation, therefore, it is safe, economic and easy to install.

SUMMARY OF THE INVENTION

A gate type vertical elevated mast with open front, including: several sections. It is assembled section by section from bottom to the top. The first section is a welded integrated structure and the remaining parts are divided into two parts, the left parts and the right parts. Each part of the section is assembled by connecting front upright posts, back upright posts, upper beams, lower beams and brace rods. Then the left and right parts are connected with back beams and brace rods to form a gate type section with beams and brace rods at the left, right and back sides.

The abutting ends of the sections are positioned by inserting die nipples into die collars. Then connect the two sections with connecting pins and safety pins. The safety pins are used to prevent the looseness of the connecting pins.

Assemble the two parts of sections before install the mast. Then install a hoisting device on the substructure of the mast which is used to raise the first section of the mast. When the first section is on the supporter, connect the first section and the second section. Then raise the second section and connect the third section with the second section. Repeat the action until finishing the installation of the mast.

The sequence of dismantling the mast is the reverse to that of installation.

Each section of the mast has two parts, left part and right part, which can be connected quickly to form a mast section. Then the whole mast can be installed quickly by connecting sections in a given order. It can also be dismantled quickly and easily, therefore, greatly reduces time for preparation.

The entire installation procedure is performed on a ground base. Therefore, the whole process of the installation of the mast requires a minimum of the area and avoids the overhead operation. It takes less time to prepare before transportation. It is practical and economical and, very welcomed by people in city, mountain and farmland with limited areas.

DESCRIPTIONS OF DRAWINGS

FIGS. 1(*a*) and (*b*) show the structure of the vertical elevated gate type mast with open front with FIG. 1(*a*) being the front view and FIG. 1(*b*) being the side view.

DETAILED DESCRIPTION OF THE INVENTION

The description of the following procedure of the new practical patent is according to FIGS. 1, 2, 3, 4, 5 and 6.

Figures 1A, 1B:
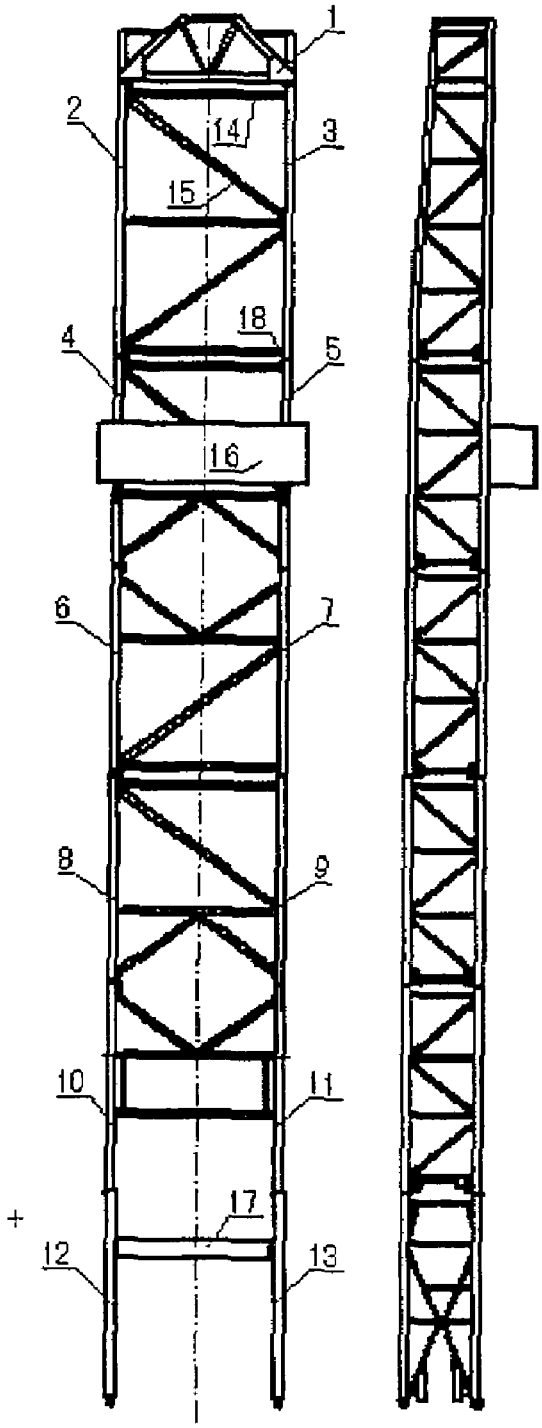

Refer to FIGS. 1(*a*) and 1(*b*), this new practical equipment is a gate type vertical elevated mast with open front, which seven sections and it is installed from bottom to the top section by section. Except the first section 1 is a welded integrated structure, the rest sections are divided into two parts, the left parts and the right parts, i.e. the 2nd section has two parts: the left part 2 and the right part 3; the 3rd section has two parts: the left part 4 and the right part 5; the 4th section has two parts: the left part 6 and the right part 7; the 5th section has two parts: the left part 8 and the right part 9; the 6th section has two parts: the left part 10 and the right part 11; the 7th section has two parts: the left part 12 and the right part 13. Each part of the section is assembled by connecting front upright posts, back upright posts, upper beams, lower beams and brace rods. Then the left and right parts are connected with back beams and brace rods to form a gate type section with beams and brace rods at the left, right and back sides.

Figure 2:
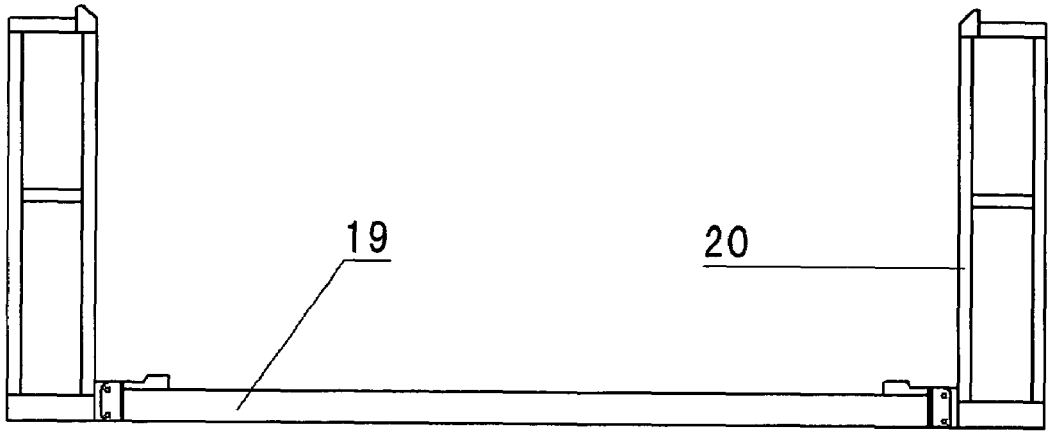
FIG. 2 shows the structure of ground assembling supporter.

FIGS. 1(*a*) and 1(*b*) illustrate back beams 14 and brace rods 15 of the 2nd section respectively, the racking platform 16 and the connecting beam 17 for rotary table. Please install according to FIG. 2-6. When install, first assemble the left parts and the right parts, i.e. left part 2 and right part 3, left part 4 and right part 5, left part 6 and right part 7, left part 8 and right part 9, left part (10) and right part (11) and left part (12) and right part (13) with back beams 14 and brace rods 15 respectively to form a mast section on the ground supporter shown in FIG. 2. FIG. 2 illustrates connecting yoke (19) and holder 20. Transport the assembled sections to the wellhead center by small truck in a given order.

Figure 3:
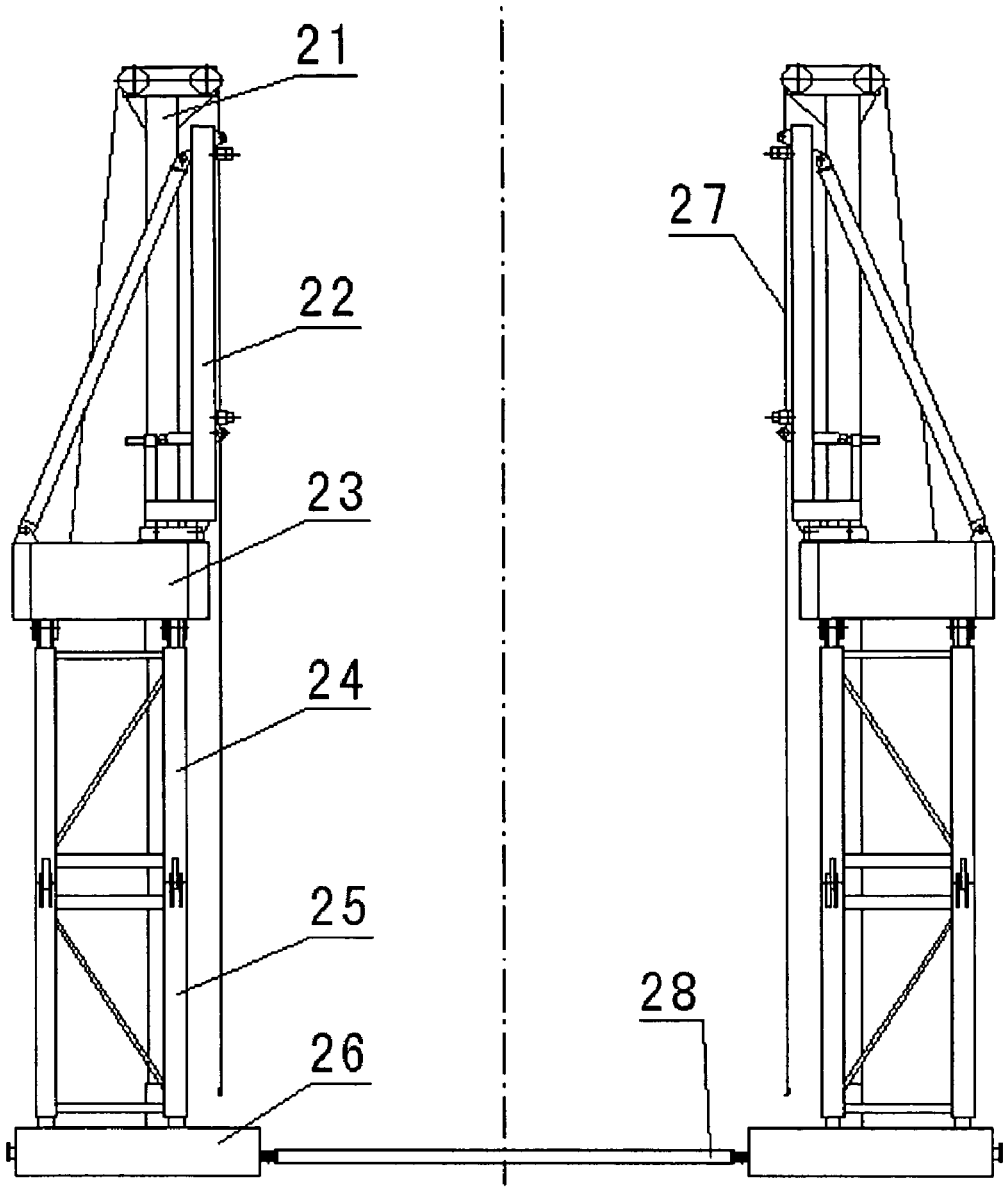
FIG. 3 shows the installation of substructure and the lifting supporter of the mast.

As shown in FIG. 3, install lifting hydraulic oil cylinder or hydraulic drawworks in the substructure of the mast. Install lifting oil cylinder or hydraulic drawworks on the substructure with lift wireline 27 connected. Hang the wireline connection on the special hoisting parts on the mast.

Figure 4:
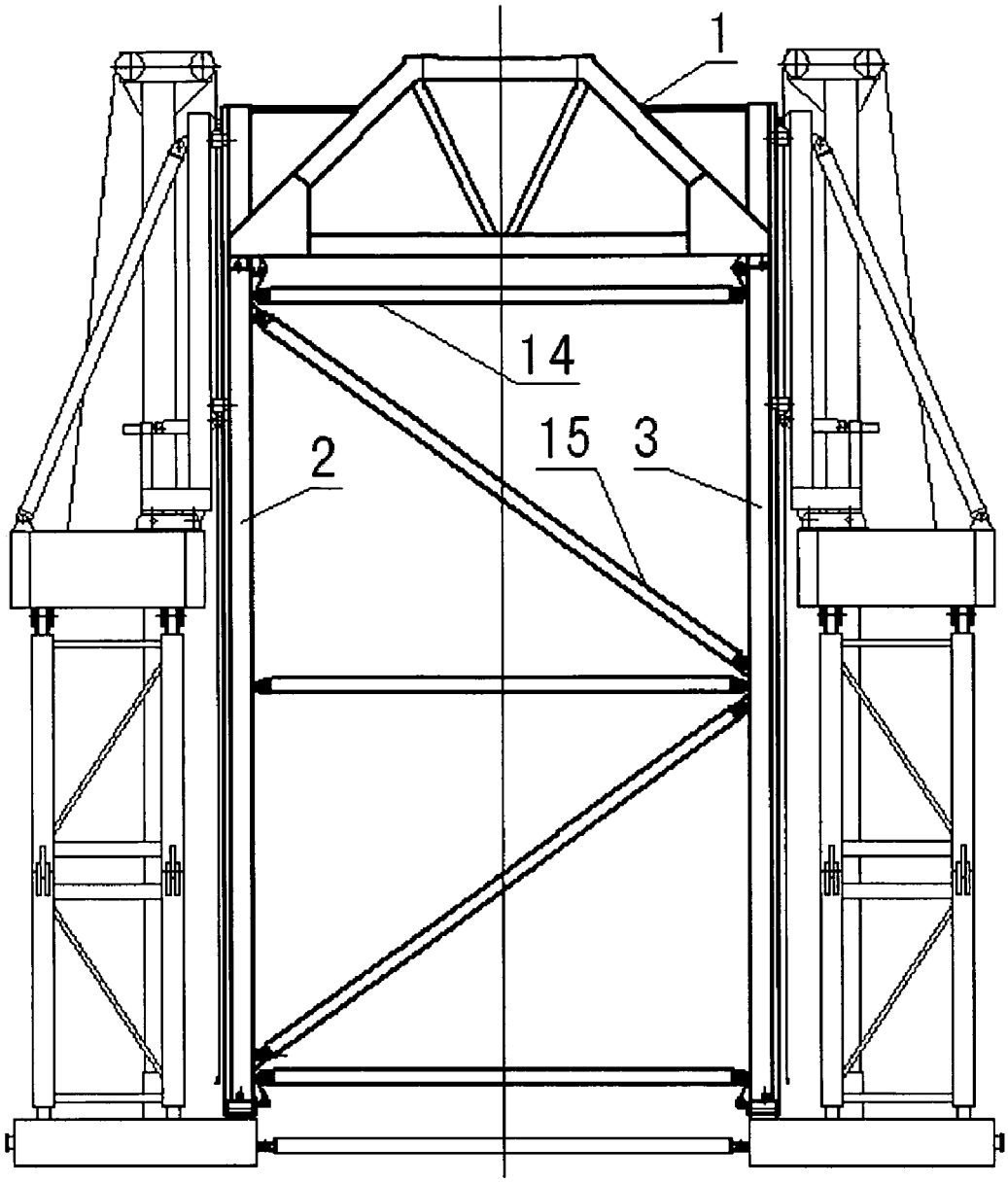
FIG. 4 shows the installation of Section 1 and Section 2 of the mast.

As shown in FIG. 4, first install the crown block on the first section 1 of the mast, and then install the first section on the second mast section 2, 3. Slowly raise the second mast section 2, 3 to position with lifting oil cylinder or hydraulic drawworks and support with supporting shaft on the lifting supporter 22.

Figure 5:
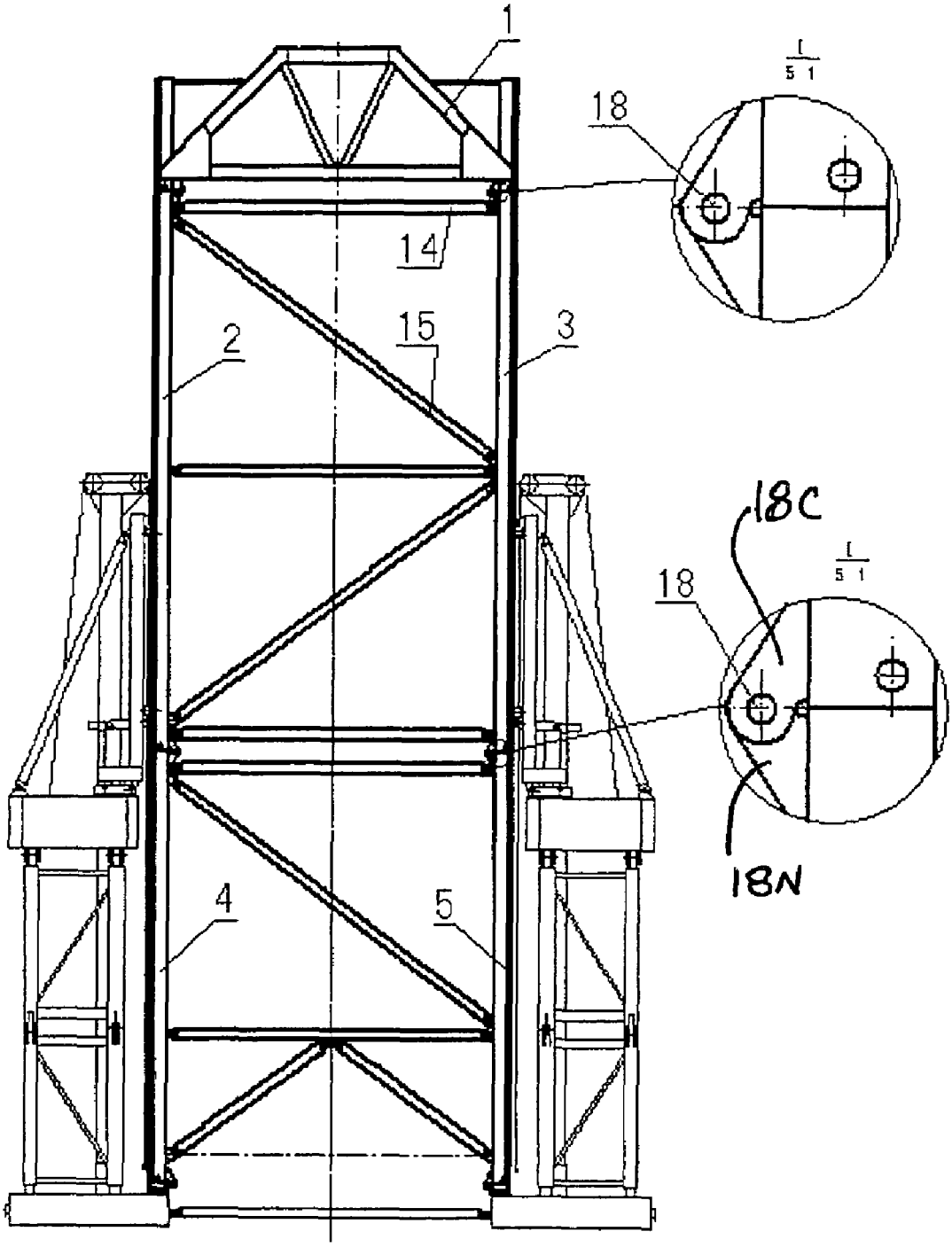
FIG. 5 shows the installation of Section 1, Section 2 and Section 3 of the mast.
Figure 6:
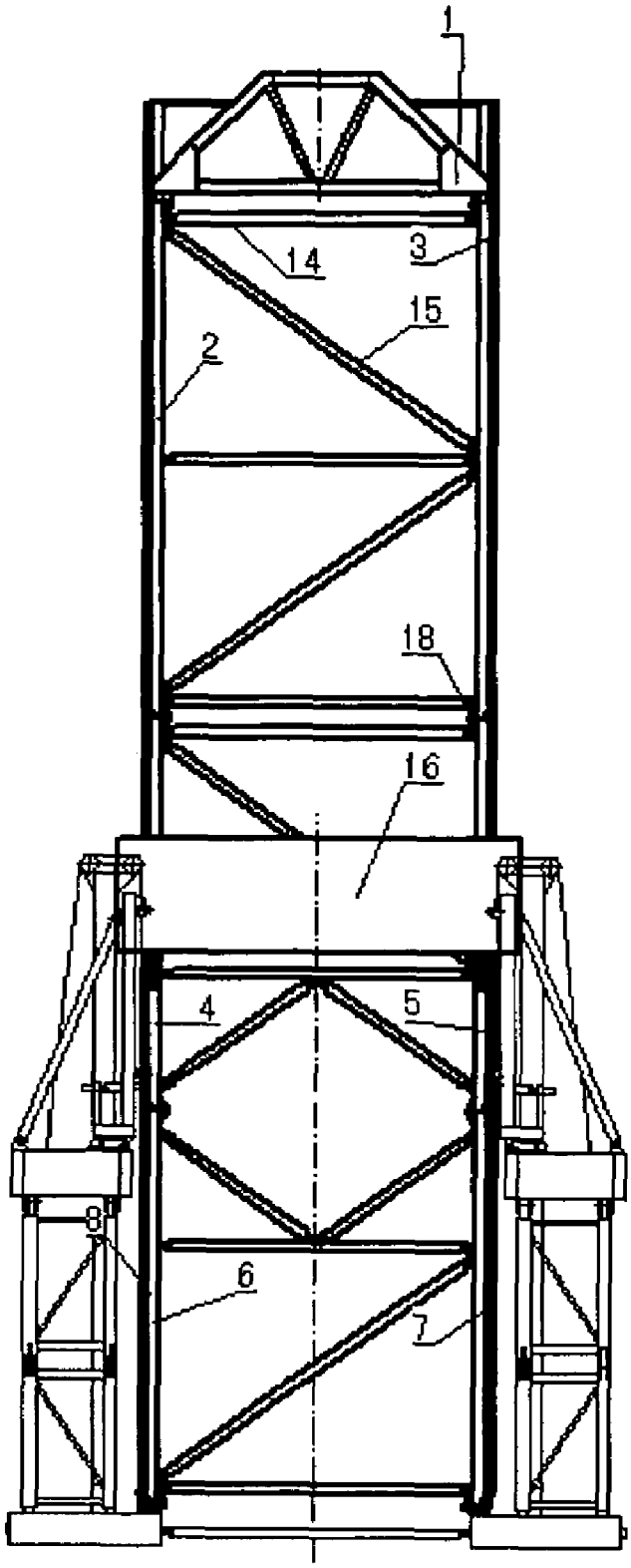
FIG. 6 shows the installation of Section 1, Section 2, Section 3 and Section 4 of the mast.

Then as shown in FIG. 5, connect the 3rd section 4, 5 with the 2nd section 2, 3 and then raise the 3rd section 4, 5. Then according to FIG. 6, connect the 4th section 6, 7 with the 3rd section 4, 5 and then raise the 4th section 6, 7. Repeat the action according to the given order and raise each section to the right position to complete the installation of the whole mast.

When assembling the above mentioned sections, the abutting ends of adjacent sections are positioned by inserting die nipples 18N into die collars 18C. Then connect the two sections with connecting pins 18 or safety pins.

Descriptions of other parts illustrated in FIG. 5 include: lifting rod 21; upper seat 23; upper connecting yoke 24; lower connecting yoke 25; lower seat 26; and left and right connecting yoke 28.

The sequence of dismantling the mast is the reverse to that of installation.

What is claimed is:

1. A vertically elevated gate mast with open front, comprising:

multiple sections having back, right, and left sides, the multiple sections being connected one above another to form the vertically elevated gate mast, wherein a first section is a welded integrated structure and $2^{nd}$ to nth rectangular, box-shaped sections that are divided into a left part and a right part, each of the left and right parts having a plurality of straight members including a front upright post, a back upright post, an upper beam, a lower beam, back and side beams, and at least one brace rod, wherein the back beam and the brace rod of the left part of each $2^{nd}$ to nth section are connected the corresponding right part, and the back beam and the brace rod of the right part of each $2^{nd}$ to nth section are connected the corresponding left part, whereby each of the $2^{nd}$ to nth rectangular, box-shaped gate sections includes the side beams, the back beams, and the brace rods being positioned at the left, right and back sides.

2. The vertically elevated gate mast with open front in claim 1, wherein each of the $2^{nd}$ to nth sections includes multiple upper abutting ends and multiple lower abutting ends, wherein the upper abutting ends of each section in the vertically elevated gate mast are connected to the lower abutting ends of the adjoining section connecting pins or safety pins.

3. The vertically elevated gate mast with open front in claim 1, wherein the front posts are orthogonal to the back beams and the side beams.

4. The vertically elevated gate mast with open front in claim 1, wherein the front posts are parallel to the back posts.

5. The vertically elevated gate mast with open front in claim 1, wherein each of the $2^{nd}$ to nth sections includes multiple upper abutting ends and multiple lower abutting ends, the upper abutting ends including one of die nipples and die collars, and the lower abutting ends including the other of the die nipples and the die collars, wherein the die nipples of each section in the vertically elevated gate mast are connected to the die collars of the adjoining section by connecting pins or safety pins.

* * * * *